United States Patent [19]

Boubouleix

[11] Patent Number: 4,491,843

[45] Date of Patent: Jan. 1, 1985

[54] PORTABLE RECEIVER WITH HOUSING SERVING AS A DIPOLE ANTENNA

[75] Inventor: Albert Boubouleix, Paris, France

[73] Assignee: Thomson-CSF, Paris, France

[21] Appl. No.: 341,120

[22] Filed: Jan. 20, 1982

[30] Foreign Application Priority Data

Jan. 23, 1981 [FR] France ..... 81 01291

[51] Int. Cl.[3] ..... H01Q 1/24; H01Q 9/16

[52] U.S. Cl. ..... 343/702; 343/794; 343/822; 455/269

[58] Field of Search ..... 343/702, 701, 899, 829, 343/830, 846, 847, 898, 718, 793, 794, 820, 822, 807, 850, 852, 860; 455/89, 90, 95, 128, 129, 269, 272, 346, 347, 351

[56] References Cited

U.S. PATENT DOCUMENTS

| | | | |
|---|---|---|---|
| 2,828,413 | 3/1958 | Bowers | 343/702 |
| 3,545,002 | 12/1970 | Fenster | 343/830 |
| 3,573,628 | 4/1971 | Cramer et al. | 343/702 |
| 3,587,107 | 6/1971 | Ross | 343/830 |
| 3,736,591 | 10/1971 | Rennels et al. | 343/702 |
| 3,852,760 | 12/1974 | Reggia | 343/830 |
| 3,980,952 | 4/1975 | Rapshys | 455/90 |
| 4,123,756 | 10/1978 | Nagata et al. | 343/702 |

FOREIGN PATENT DOCUMENTS

| | | | |
|---|---|---|---|
| 2408578 | 8/1975 | France | 343/700 MS |

*Primary Examiner*—Eli Lieberman
*Assistant Examiner*—Michael C. Wimer
*Attorney, Agent, or Firm*—Oblon, Fisher, Spivak, McClelland & Maier

[57] ABSTRACT

The antenna for equipping a portable receiver comprises a metal plate and a metal box containing the receiver components and which is provided with a surface facing the metal plate, the metal box behaving in the manner of a virtual plate positioned half-way up the box.

5 Claims, 3 Drawing Figures

PORTABLE RECEIVER WITH HOUSING SERVING AS A DIPOLE ANTENNA

BACKGROUND OF THE INVENTION

The present invention relates to an antenna and more specifically a small antenna for equipping a portable receiver.

The term small antenna is understood to mean an antenna, whose size is well below that of the wavelength of the waves received.

This type of receiver is more particularly used in systems for the transmission of radio signals from a basic transmitter and which are intended for users, carrying portable receivers, moving about within a perimeter defined by a radius of limited size around their telephone or radio telephone. These systems are more particularly known as unilateral call systems or as "Eurosignal" systems. In such systems it is desirable for the user's comfort to reduce the size of the receiver and the antenna incorporated therein to the greatest possible extent.

The antenna conventionally comprises two metal plates forming an electric dipole between which is placed the receiver. A matching circuit generally formed by an inductor is located between the receiver and each of the metal plates forming the dipole.

Efforts at reducing the overall dimensions have hitherto been mainly directed at reducing the volume occupied by the receiver and have been greatly helped by the contributions made by microelectronics in this field.

However, without changing the antenna structure it was difficult to envisage reducing the volume occupied by it.

Due to the fact that it complies with experience gained in the field of antennas and on the basis of repeated satisfactory use, it seemed difficult to cast doubts on the hitherto used antenna structure.

However, the present invention is directed at a novel antenna structure having reduced overall dimensions compared with the hitherto used antenna.

BRIEF SUMMARY OF THE INVENTION

According to the invention the small antenna for equipping a portable receiver comprises a metal plate and a metal box or case containing the receiver components and which is provided with a surface facing the metal plate. It is in fact surprising to note that the metal box behaves like a virtual plate positioned half-way up the metal box, as has been shown by the results of experiments performed in connection with the antenna according to the invention.

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBODIMENTS

Figure 1:
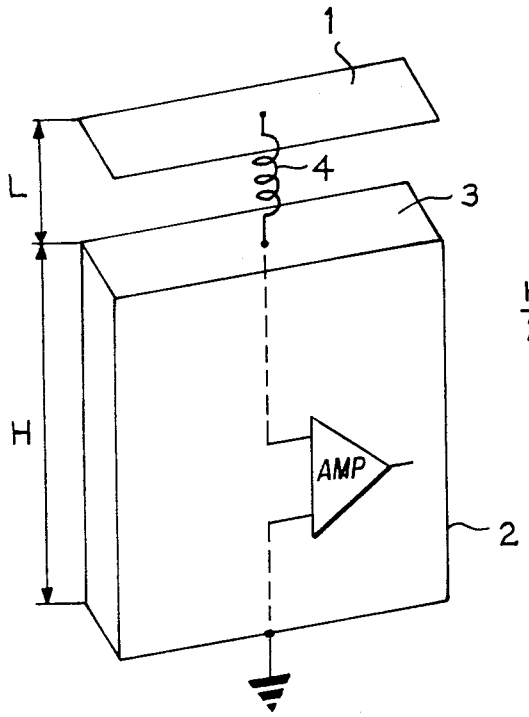
FIG. 1 the structure of an antenna according to the invention.

The antenna of FIG. 1 comprises a metal plate 1 and a metal case or box 2 of height H containing the components constituting the receiver (said components not being shown in the drawing). In exemplified manner the metal box has a parallelepipedic shape, but any random shape would be suitable. One surface 3 of parallelepiped 2 faces plate 1 at a distance L from the latter. For example the surface area of surface 3 is the same as that of plate 1. The term small antenna is used because L is much less than the wavelength of the waves received.

An inductor for bringing about the matching of the receiver antenna is provided with a first terminal connected to plate 1 and a second terminal connected to a first input of an amplifier (shown in FIG. 1) positioned within the metal box and forming part of the input stage of the receiver, a second input of the amplifier being connected to the box.

Figure 2:
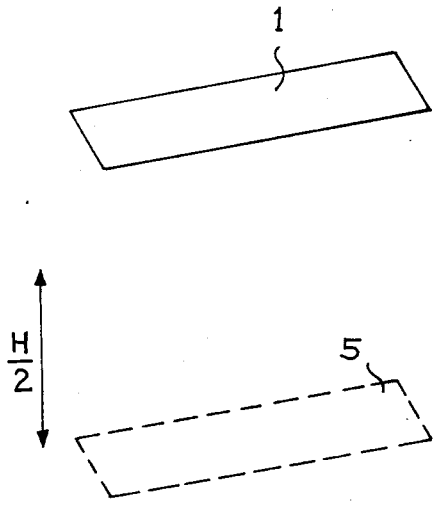
FIG. 2 an equivalent circuit diagram of the structure of FIG. 1.

Experiments have proved that the thus formed antenna behaves like an electric dipole having, in the manner shown in FIG. 2, a first metal plate constituted by plate 1 and a second metal plate constituted by a virtual metal plate 5 located half-way up (H/2) box 2.

Figure 3:
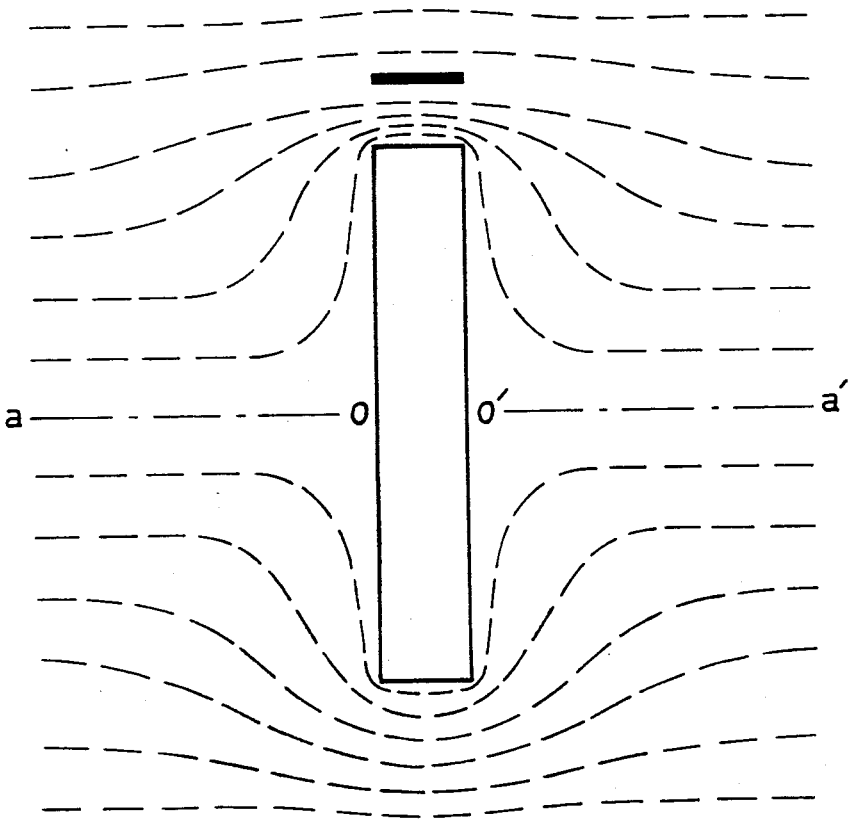
FIG. 3 a diagram showing the equipotential lines obtained when using the antenna according to the invention in a rheographic tank.

For this purpose it is merely necessary to refer to FIG. 3 showing the equipotential lines obtained about the antenna according to the invention, when the latter is placed in a uniform electric field within a rheographic tank. It is possible to see in FIG. 3 a concentration of the field passing between the foils of the capacitor formed by the metal plate and by the surface of the metal box facing said metal plate. It is also possible to see a separating line aa', which shows that the electric field passing round the bottom of the box is not used. It can also be seen that the electric field is zero towards the centre of the box (points O and O'). It is also apparent that the tangential component of the electrical field is zero at the limits of the box.

Thus, everything takes place as if the assembly formed by the metal plate and the metal box behaved like a capacitor, whose first foil is constituted by the metal plate and whose second foil is constituted by a virtual plate positioned half-way up the box and not by the surface of the box facing the metal plate.

The structure of the antenna has a number of advantages compared with that of the conventionally used antenna.

A first advantage is that the overall dimensions are reduced. More specifically the height of the antenna-box assembly is reduced by a height equal to L.

A second advantage is that far fewer inductors are used. Thus, previously the signals supplied by the two metal plates were in phase opposition, so that it was necessary to provide a transformer whose centre point was constituted by a first winding provided with a first terminal connected to the first plate, a second terminal connected to the second plate and a second winding provided with a first terminal connected to the input of an amplifier forming part of the input stage of the receiver and a second terminal brought to reference potential, the centre of the first winding also being brought to said reference potential. In the antenna according to the invention the second plate is in fact constituted by the receiver box. Thus, it is merely necessary to connect the first terminal of the amplifier to plate 1 via inductor 4 and a second terminal of the amplifier to box 2 which, by definition, forms a reference potential.

A third advantage is that the metallization of the receiver box brings about an impermeability to interference electric fields. The electronic circuits constituting the receiver are consequently protected from direct coupling with the external environment.

What is claimed is:

1. An antenna for equipping a portable radio receiver wherein said antenna comprises an electric dipole with one pole of said electric dipole comprising a metal box which contains all of the components of said radio receiver and which forms a reference potential plane having zero electric field for said receiver and wherein the other pole of said electric dipole is a flat metal plate with said metal plate being electrically connected to the electronics components of said radio receiver and wherein said metal plate is fixedly facing and spaced from a surface of said metal box and wherein the gap of the spacing between said metal plate and said surface of said metal box is of a value such that it is much less than the wave length of said radio receiver whereby said dipole formed from said metal box and said flat plate is such that the location of said reference potential plane of said one pole is equal to half the distance between said surface of said metal box and the surface which is opposite said surface of said metal box.

2. An antenna according to claim 1, wherein the surface of the metal box facing the metal plate has a surface area substantially equal to that of said metal plate.

3. An antenna according to claims 1 or 2, wherein the metal box has a parallelepipedic shape.

4. An antenna according to claims 1 or 2, wherein said antenna is matched to the said receiver by means of an inductor having a first terminal connected to the metal plate and a second terminal connected to the receiver.

5. An antenna according to claim 4, wherein the connection between the inductor and the receiver is provided by means of an amplifier equipped with a first input connected to the second terminal of the inductor and a second input connected to the metal box.

* * * * *